US011572699B2

(12) United States Patent
Paisley et al.

(10) Patent No.: US 11,572,699 B2
(45) Date of Patent: Feb. 7, 2023

(54) EMBEDDED CONCRETE MARKING

(71) Applicants: Chris Paisley, Washington Court House, OH (US); Kevin Paisley, Washington Court House, OH (US)

(72) Inventors: Chris Paisley, Washington Court House, OH (US); Kevin Paisley, Washington Court House, OH (US)

( * ) Notice: Subject to any disclaimer, the term of this patent is extended or adjusted under 35 U.S.C. 154(b) by 0 days.

(21) Appl. No.: 17/166,964

(22) Filed: Feb. 3, 2021

(65) Prior Publication Data

US 2021/0238866 A1 Aug. 5, 2021

Related U.S. Application Data

(60) Provisional application No. 62/969,604, filed on Feb. 3, 2020.

(51) Int. Cl.
*E04F 15/12* (2006.01)

(52) U.S. Cl.
CPC ..... *E04F 15/12* (2013.01)

(58) Field of Classification Search
CPC ..... B28D 1/045; E01C 23/0993; B24B 7/18; E04F 15/12
See application file for complete search history.

(56) References Cited

U.S. PATENT DOCUMENTS 1,605,197 A * 11/1926 Anfield ..... E04F 15/14 404/74
1,754,253 A * 4/1930 Avery ..... E04F 15/12 427/137
2,042,964 A * 6/1936 Rinehart ..... B32B 27/00 264/31
2,898,825 A 8/1959 Walker
4,376,007 A 3/1983 Eigenmann
5,624,510 A * 4/1997 Uchida ..... B28B 1/008 428/38
5,679,298 A * 10/1997 Uchida ..... A23G 3/54 264/122
5,857,453 A 1/1999 Caven
6,236,798 B1 * 5/2001 Finzel ..... G02B 6/00 385/136
6,247,279 B1 * 6/2001 Murat ..... E04C 3/34 52/231
7,976,963 B2 * 7/2011 Olson, III ..... C04B 41/5076 52/311.1

(Continued)

*Primary Examiner* — Brian E Glessner
*Assistant Examiner* — Daniel J Kenny

(57) ABSTRACT

An improved manner of marking concrete is provided by an embedded concrete marking. The embedded concrete marking is made of concrete that is different than the concrete into which the marking is embedded. A method of creating an embedded concrete marking comprises identifying a location on the surface of concrete where an embedded concrete marking is to be created, cutting a trench into the surface of the concrete at the identified location, pouring a concrete mixture into the trench to a level where a float height of the concrete mixture is above the surface of the concrete, the concrete mixture being different when dry than the concrete into which the trench has been cut, letting the concrete mixture at least partially harden, and removing a portion of the hardened concrete mixture to create a top surface of the concrete mixture that will form an embedded concrete marking.

20 Claims, 4 Drawing Sheets

(56) References Cited

U.S. PATENT DOCUMENTS

| | | | | |
|---|---|---|---|---|
| 11,268,249 | B2 * | 3/2022 | Mahaffey, Jr. | E01C 23/088 |
| 2003/0103810 | A1 | 6/2003 | Wiley | |
| 2005/0207840 | A1 | 9/2005 | Oliver | |
| 2017/0051522 | A1 * | 2/2017 | Velazquez | E04F 21/24 |

* cited by examiner

EMBEDDED CONCRETE MARKING

PRIORITY

The present application claims the benefit of domestic priority based on U.S. Provisional Patent Application 62/969,604 filed on Feb. 3, 2020, the entirety of which is incorporated herein by reference.

BACKGROUND

The desire to safeguard workers and other individuals in various environments has led to an increasing use of safety features. Such safety features include line markings on floors that help identify certain areas within certain environments.

Line markings on floors can be used in warehouses and manufacturing facilities to identify walkways and hazardous areas. The Occupational Safety and Health Administration requires colored markings on floors to identify certain hazards. In addition, it can be desirable to provide markings on floors to help identify certain areas for convenience purposes. For example, line markings are often used for sectioning off storage areas or for organizing traffic flow.

The provision of line markings can pose challenges when the floor to be marked is concrete. Typically, concrete floors are marked by painting onto the concrete floor with tinted floor paint and/or epoxies. The process can be laborious. First, the concrete floor must be cleaned to remove any dirt or laitance from the concrete floor surface. This cleaning is typically done by acid etching, diamond grinding, and/or steel shot blasting. Next the edges of the line marking are taped off with masking tape. A pigmented paint or epoxy is then applied, and after it has dried or cured, the masking tape is removed. In another conventional process, adhesive-backed tape products are used to make the line markings.

Unfortunately, these conventional processes have been less than ideal. Painted or epoxy lines applied in the typical manner do not wear well and soon begin to fade. This is particularly true in areas of high traffic, in areas where fork trucks drive, and in areas where items, such as wood or metal pallets, slide across the floor. Thus, markings applied directly onto the concrete floor can become scratched and/or abraded off over a short period of time. This is even more true for adhesive-backed tape products.

There is therefore a need for an improved process for providing markings on a concrete floor. There is further a need for a concrete floor marking process that is easier to perform than conventional processes. There is still further a need for a concrete floor marking that provides improved durability.

SUMMARY

The present invention satisfies these needs. In one aspect of the invention, an improved method and system is provided for creating an embedded concrete marking in a concrete floor.

In another aspect of the invention, a method of creating an embedded concrete marking in a concrete floor provides an improved marking.

In another aspect of the invention, an embedded concrete marking is provided that offers improved durability.

In another aspect of the invention, a concrete marking is composed of concrete that is different than concrete the marking is embedded into.

In another aspect of the invention, a concrete marking is composed of concrete that is a different color than concrete the marking is embedded into.

In another aspect of the invention, a method of creating an embedded concrete marking comprises cutting a trench into the surface of concrete, pouring a concrete mixture into the trench to a level above the surface of the concrete, the concrete mixture being different when dry than the concrete into which the trench is cut, and removing a portion of the concrete mixture to create a top surface of the concrete mixture that will form an embedded concrete marking.

In another aspect of the invention, a method of creating an embedded concrete marking comprises cutting a trench into the surface of a concrete floor, pouring a concrete mixture into the trench to a level above the surface of the concrete floor, the concrete mixture being different when dry than the concrete floor, and removing a portion of the concrete mixture to create a top surface of the concrete mixture that will form an embedded concrete marking.

In another aspect of the invention, a method of creating an embedded concrete marking comprises identifying a location on the surface of a concrete floor where an embedded concrete marking is to be created; cutting a trench into the surface of the concrete floor at the identified location; pouring a concrete mixture into the trench to a level where a float height of the concrete mixture is above the surface of the concrete floor, the concrete mixture being different when dry than the concrete floor; letting the concrete mixture at least partially harden; and removing a portion of the hardened concrete mixture to create a top surface of the concrete mixture that will form an embedded concrete marking.

In another aspect of the invention, a method of creating an embedded concrete marking comprises identifying a location on the surface of a concrete floor where an embedded concrete marking is to be created; cutting a trench into the surface of the concrete floor at the identified location; pouring a concrete mixture into the trench to a level where a float height of the concrete mixture is above the surface of the concrete floor, the concrete mixture being different when dry than the concrete floor; letting the concrete mixture at least partially harden; and removing a portion of the hardened concrete mixture to create a top surface of the concrete mixture that will form an embedded concrete marking, wherein the top surface is at least partially flush with the concrete floor.

In another aspect of the invention, a method of creating an embedded concrete marking comprises identifying a location on the surface of a concrete floor where an embedded concrete marking is to be created; cutting a trench into the surface of the concrete floor at the identified location; pouring a concrete mixture into the trench to a level where a float height of the concrete mixture is above the surface of the concrete floor, the concrete mixture being a different color when dry than the concrete floor; letting the concrete mixture at least partially harden; and removing a portion of the hardened concrete mixture to create a top surface of the concrete mixture that will form an embedded concrete marking.

In another aspect of the invention, a method of creating an embedded concrete marking comprises identifying a location on the surface of a concrete floor where an embedded concrete marking is to be created; cutting a trench into the surface of the concrete floor at the identified location; pouring a concrete mixture into the trench to a level where a float height of the concrete mixture is above the surface of the concrete floor, the concrete mixture being a different texture when dry than the concrete floor; letting the concrete mixture at least partially harden; and removing a portion of the hardened concrete mixture to create a top surface of the concrete mixture that will form an embedded concrete marking.

In another aspect of the invention, a concrete surface has an embedded concrete marking made by the process comprising identifying a location on the surface of concrete where an embedded concrete marking is to be created; cutting a trench into the surface of the concrete at the identified location; pouring a concrete mixture into the trench to a level where a float height of the concrete mixture is above the surface of the concrete, the concrete mixture being different when dry than the concrete into which the trench is cut; letting the concrete mixture harden; and removing a portion of the hardened concrete mixture to create a top surface of the concrete mixture that will form an embedded concrete marking.

In another aspect of the invention, a concrete floor has an embedded concrete marking made by the process comprising identifying a location on the surface of the concrete floor where an embedded concrete marking is to be created; cutting a trench into the surface of the concrete floor at the identified location; pouring a concrete mixture into the trench to a level where a float height of the concrete mixture is above the surface of the concrete floor, the concrete mixture being different when dry than the concrete floor; letting the concrete mixture harden; and removing a portion of the hardened concrete mixture to create a top surface of the concrete mixture that will form an embedded concrete marking.

In another aspect of the invention, a system for creating an embedded concrete marking comprises a trench cutting device adapted to cut a trench into the surface of concrete at an identified location; a concrete mixture in an amount to be poured into the trench to a level where a float height of the concrete mixture is above the surface of the concrete, the concrete mixture being different when dry than the concrete into which the trench is cut; and a removal device adapted to remove a portion of the hardened concrete mixture to create a top surface of the concrete mixture that will form an embedded concrete marking.

In another aspect of the invention, a system for creating an embedded concrete marking comprises a trench cutting device adapted to cut a trench into the surface of a concrete floor at an identified location; a concrete mixture in an amount to be poured into the trench to a level where a float height of the concrete mixture is above the surface of the concrete floor, the concrete mixture being different when dry than the concrete floor; and a removal device adapted to remove a portion of the hardened concrete mixture to create a top surface of the concrete mixture that will form an embedded concrete marking.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to an embedded concrete marking. In particular, the invention relates to embedded concrete markings in concrete floors for marking lines and other areas. Although the embedded concrete marking is illustrated and described in the context of being useful for warehouses and industrial facilities, the present invention can be useful in other instances. Accordingly, the present invention is not intended to be limited to the examples and embodiments described herein.

Figure 1:
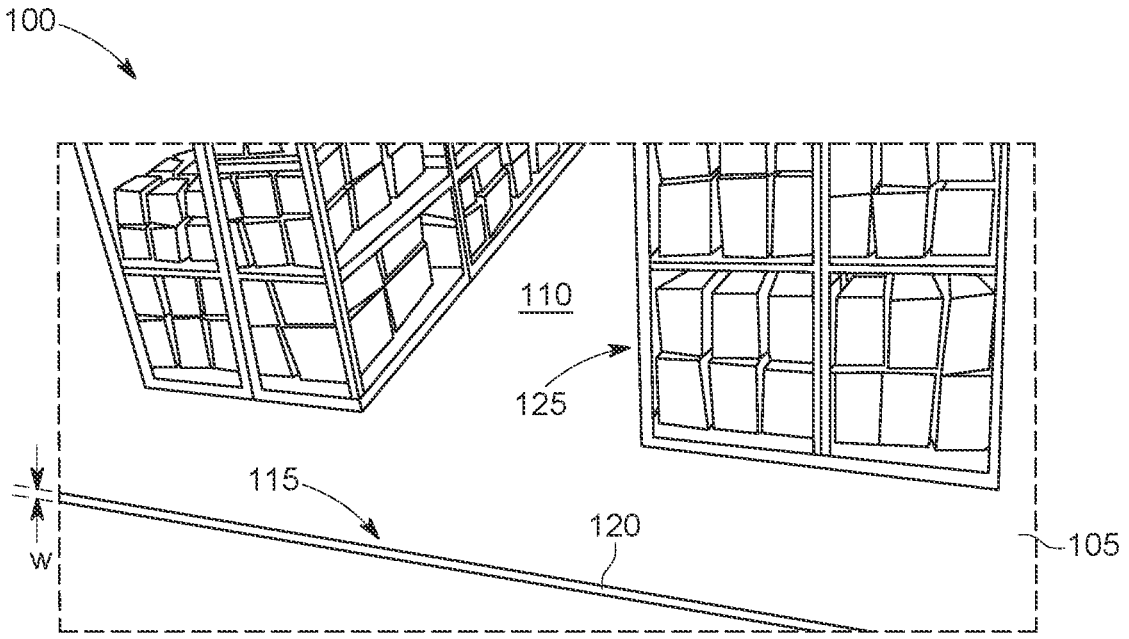
FIG. 1 is a schematic diagram of an embedded concrete marking according to the invention.

FIG. 1 shows a system 100 for marking a surface of concrete, such as a concrete floor 105. The concrete floor 105 may be located in any indoor or outdoor environment. Of particular interest is the marking of a concrete floor 105 in a warehouse or manufacturing area 110 where hazards are present and where wear and tear on the concrete floor 105 can be extreme. The system 100 is not limited to a concrete floor 105 in a warehouse or manufacturing area 110 but can be used in any area where there is a concrete floor 105 or other concrete surface that needs to be permanently marked, such as sidewalks, roads, playgrounds, walls, structures, parks, amusement parks, runways, parking lots, restaurants, and stores.

As can be seen in FIG. 1A, the system 100 for marking a concrete floor 105 includes an embedded concrete marking 115. The embedded concrete marking 115 can be in the form of a line 120 having any desired width, w. The embedded concrete marking 115 is positioned in a concrete floor 105 at a desired location so that it provides a visual indicator of a hazard or other area. For example, as shown in FIG. 1, the embedded concrete marking 115 is positioned in a warehouse or manufacturing area 110 to indicate the proximity of a potentially hazardous area 125, such as shelves or other area where caution and awareness is needed. Instead of a line 120, the concrete marking 115 can be the entire region of the hazard or other area.

The embedded concrete marking 115 is itself made of concrete. The concrete in the embedded concrete marking 115 is different than the concrete of the concrete floor 105 so that the embedded concrete marking 115 is visually and/or texturally distinguishable from the concrete of the concrete floor 105. In one version, the embedded concrete marking 115 is a different color than the concrete floor 105. In one particular version, the embedded concrete marking 115 includes concrete that is mixed with a pigment or tint before it is cured so that when cured, the concrete is colored to a desired degree. Alternatively, the embedded concrete marking 115 can be a concrete of a different natural shade or hue than the concrete floor 105, a mixture of light and/or dark cements, or contain a mixture of light and/or dark aggregates. Commonly, a yellow pigment is used to make the embedded concrete marking 115 because the yellow color is easily recognized and is traditionally used to indicate a warning. Alternatively, any desired color can be used. Alternatively, yellow or otherwise colored glass could be used as the aggregate; white or dark cement could be used with or without color pigments; and/or photoluminescent aggregates could be used to produce glow in the dark markings.

Figure 2A:
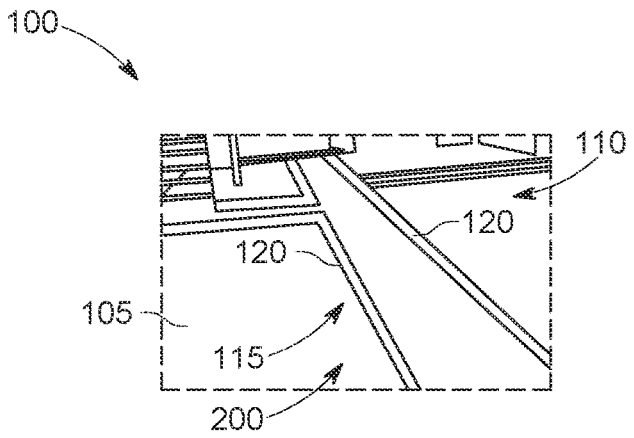
FIG. 2A is a schematic diagram of another version of an embedded concrete marking of the invention.
Figure 2B:
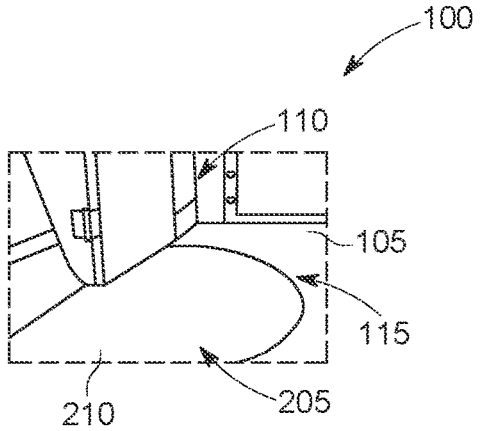
FIG. 2B is a schematic diagram of another version of an embedded concrete marking of the invention.
Figure 2C:
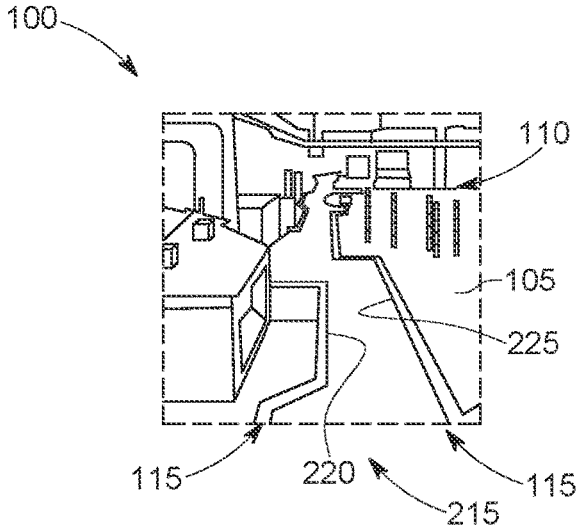
FIG. 2C is a schematic diagram of another version of an embedded concrete marking of the invention.
Figure 2D:
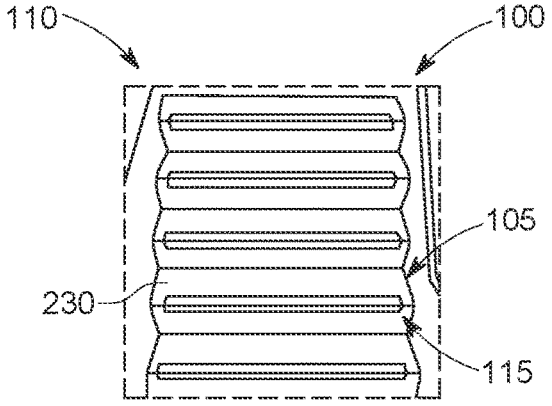
FIG. 2D is a schematic diagram of another version of an embedded concrete marking of the invention.
Figure 3A:
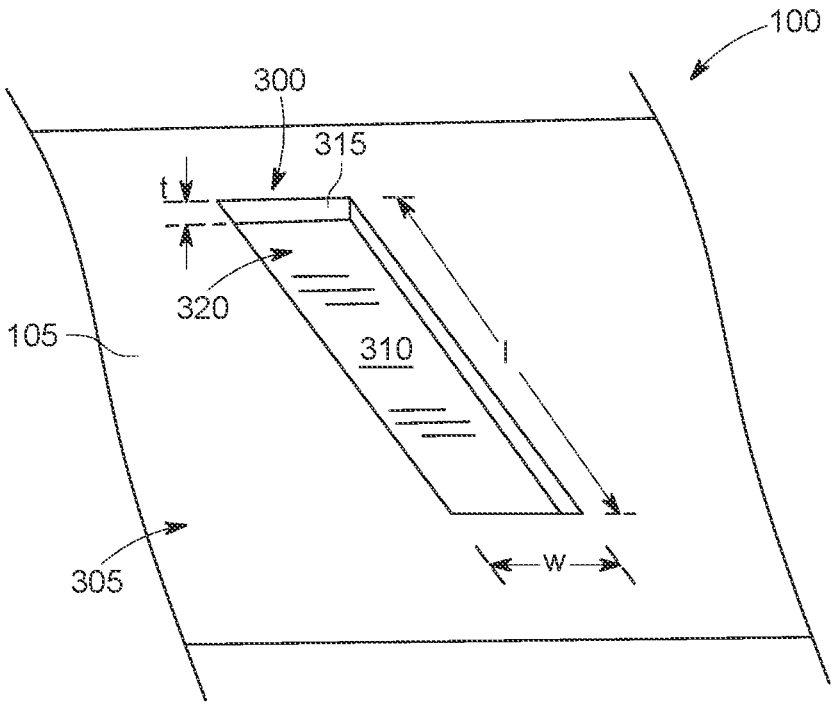
FIG. 3A is a schematic perspective view of a concrete floor being installed with an embedded concrete marking.
Figure 3B:
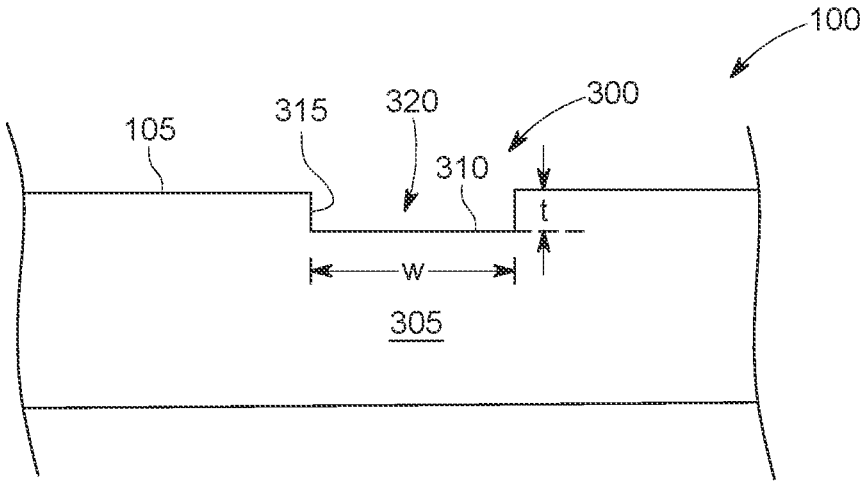
FIG. 3B is a schematic sectional side view of FIG. 2A.

Different examples of the use of the system 100 of the present invention are shown in FIGS. 2A, 2B, 2C, and 2D. As can be seen in FIG. 2A, the embedded concrete marking 115 can include multiple lines 200 each of which is a line 120 as described above and that can serve many purposes. For example, the multiple lines 200 can be used to help direct traffic flow or to cordon off different areas of an environment. FIG. 2B shows the embedded concrete marking 115 taking the form of a geometric shape 205, in this particular version that of an at least partial semi-circle shape 210, to indicate an area of concern. In the version of FIG. 2B, the semi-circle shape 210 shows the path of a door when it swings open and shut. FIG. 2C shows multiple 215 embedded concrete markings 115 comprising a first embedded concrete marking 220 having a first color and a second embedded concrete marking 225 having a second color that is different than the first color. FIG. 2D shows an example of the embedded concrete marking 115 being used when the concrete floor 105 is in the form of a step 230 or a series of steps 230.

A process for the installation of the system 100 of the present invention whereby an embedded concrete marking 115 is installed into a concrete floor 105 is shown in FIGS. 3A, 3B, 4A, and 4B. After a desired location of an embedding concrete marking 115 is identified, a trench associated with the location is created, such as by cutting the trench 300 into the surface of a concrete slab 305 that forms the concrete floor 105. The trench 300 can be a recess, cavity, indentation, alcove, depression, hole, hollow, nook, cranny, or the like that extends into a surface of a cured and set concrete slab 305. The trench 300 can be cut into the top surface of a concrete slab 305 and which is the concrete floor 105 that is to be marked or can be a already or previously created trench 300 in the concrete slab 305. The trench 300 can be any desired width, w, and length, I, depending on the desired size of the embedded concrete marking 115 to be made. For example, when the trench 300 is a line, it can have a width of at least about ⅛ inch, at least about ¼ inch, at least about ½ inch, and are commonly from about 1 inch to about 8 inches, and more commonly from about 2 inches to about 6 inches. When the marking is something other than a line, it can have wider widths. When the marking is a line, it can also have any suitable length ranging for example from less than an inch to hundreds or thousands of feet long in some large warehouses and/or outdoor spaces, but are commonly from about 2 feet to about 50 feet in length. The trench 300 is shown as a rectangle in this version but can be any desired shape and can be curved or partially curved. When shaped other than rectangular, the dimensions of the trench can be equivalent dimensions to those discussed above. By equivalent dimension herein and throughout it is meant that if a rectangular shape were to be replaced with a non-rectangular shape, the equivalent dimension would be the dimension of the non-rectangular shape that results in an area calculation that is generally the same as the area of the rectangular shape.

The trench 300 can be created by cutting into the concrete slab 305 using any of a variety of techniques. The trench may be cut to any suitable depth that provides a sufficient marking. For example, the trench 300 in one version may be cut at least about 0.25 inches deep and in another version may be cut at least 0.5 inches deep. In one particular version, the depth of the trench 300 can range from about 0.25 inches to about 0.75 inches, and more preferably is about 0.5 inches deep. In one version, the trench 300 can be cut by a process of shaving or planing. With shaving or planing, a cutter head has diamond cutting saw blades stacked together to make a wide head that saws the depth and width of the area to be to be removed. Alternatively, a concrete grinder may be used to cut the trench 300. A concrete grinder uses a circular wheel head with diamond abrasives which can grind out the concrete mixture to the depth desired. Alternatively, the portion 405 of the concrete mixture 400 can be removed by scarifying. Scarifying uses flail type cutters to fracture the surface with steel carbide tips. Alternatively, the portion 405 of the concrete mixture 400 can be removed by score cutting then chipping out with a chisel or vibrating demo hammer. A concrete saw makes cuts to the depth desired, and each cut is spaced roughly equal to the depth. After the cuts are made, a chisel bit in a chipping hammer or jack hammer or the like chips across the cutting area breaking it off to remove the concrete.

The trench 300 has a bottom surface 310 and side walls 315 that define an interior 320 of the trench 300. The bottom surface 310 and the side walls 315 are then optionally primed with a priming agent. The priming agent can be a bonding agent such as one or more of an acrylic bonding agent, an epoxy, cement slurry coat and the like.

Figure 4A:
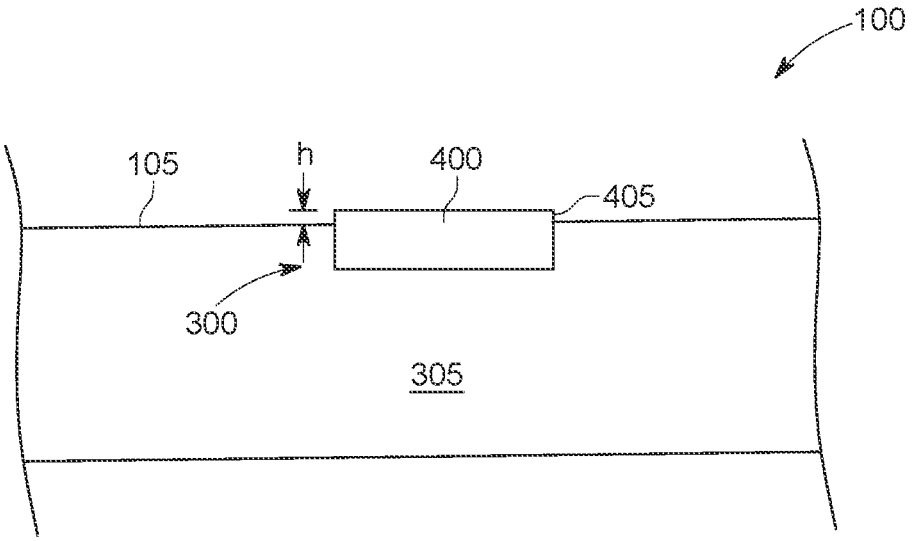
FIG. 4A is a schematic sectional side view of another step in the installation of an embedded concrete marking.

After the priming agent has dried, a concrete mixture 400 is prepared and wet concrete mixture is poured into the interior 320 of the trench 300, as shown in FIG. 4A. The concrete mixture 400 is different than the concrete in the slab 305. For example, the concrete mixture 400 can contain one or more of cement, aggregates, and/or additives that are different or that are present in different proportions than in the concrete slab 305. In one particular version, the concrete mixture 400 contains cement, aggregates, and a coloring agent, such as a one or more of iron oxide, metal oxide, synthetic pigments, and the like, wherein the coloring agent is different than the coloring agent, if any, that is used in the concrete slab 305. The concrete mixture 400 is poured to a float height, h, above the surface of the concrete floor 105 of from about 1/16 inch to about ½ inch, more preferably from about 1/16 inch to about ⅛ inch. As shown in FIG. 4A, the float height, h, is the highest point of the concrete mixture 400 filled into the trench 300 above the surface of the concrete floor 105. In one version, the entirety of the trench 300 is filled to a point at least as high as the concrete floor 105. Alternatively, at least a portion of the concrete mixture 400 can be below the surface of the concrete floor 105, for example, when recesses or indentations are desired in the completed embedded concrete marking 115.

Figure 4B:
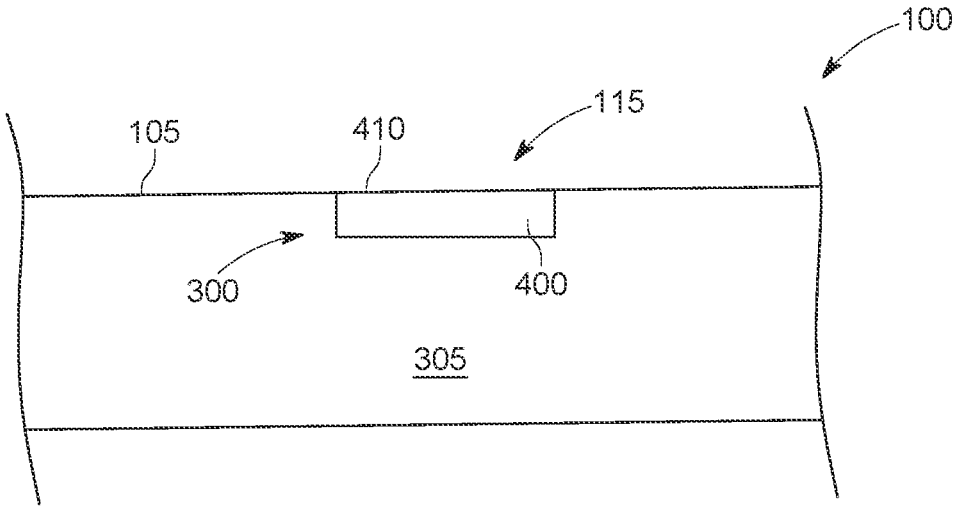
FIG. 4B is a schematic sectional side view of the final step in the installation of an embedded concrete marking.

When the concrete mixture 400 has at least partially cured and/or hardened, the portion 405 of the concrete mixture 400 that is above the level of the concrete floor 105 is removed. In one version, the removal occurs after the concrete mixture has substantially entirely cured and/or hardened. The portion 405 of the concrete mixture 400 is removed to a create a top surface 410 that is level and flush with the surface of the concrete floor 105, as shown in FIG. 4B to thereby create the embedded concrete marking 115. The portion 405 of the concrete mixture 400 can be removed in any of a variety of manners. For example, in one version, a concrete grinder may be used to grind the top of the concrete mixture 400 to remove the portion 405. A concrete grinder uses a circular wheel head with diamond abrasives which can grind down the concrete mixture to the depth desired. Alternatively, at least a portion of the portion 405 of the concrete mixture 400 can be removed by scarifying, shaving or planing, and/or score cutting and chipping. However, with these alternative versions, it is often desirable to at least finish the removal by grinding. In one version, the entire top surface 410 of the marking can be flush and lie substantially in the same plane as the concrete floor 105, at least the portion of the concrete floor that is near or abutting the marking. Alternatively, a portion of the top surface 410 can include one or more protrusions that extend upwardly and out of the plane of the surface of the concrete floor and/or one or more recesses that extend into the area of the trench and out of the plane of the surface of the concrete floor.

The top surface 410 of the embedded concrete marking 115 can then be further treated if desired. For example, the top surface 405 of the embedded concrete marking 115 can be honed and/or polished to match the shine level of the concrete floor 105. Alternatively, the top surface 405 of the embedded concrete marking 115 can be honed, polished, and/or otherwise treated to be a different shine level or a different texture than the concrete floor 105. In addition, the top surface 405 of the embedded concrete marking 115 can be sealed with a clear concrete sealer if the concrete floor 105 is sealed, if desired. The honing step and the sealing step are both or are either optional.

The system 100 and embedded concrete marking 115 of the present invention offers several advantages over conventional techniques for marking concrete floors, such as using paint or tape. For example, because the embedded concrete marking 115 is made of concrete rather than paint or tape, it is as hard as or harder than the concrete floor 105 and thus is as or more resistant to abrasions and wear and tear. The embedded concrete marking 115 will last at least as long as the floor 105 it is embedded into. In addition, the top surface 405 of the embedded concrete marking 115 is ground to be flush with the surface of the concrete floor 105. Therefore, unlike paint and tape which is slightly raised from the concrete floor 105, the embedded concrete marking 115 is less likely to snags objects sliding across the floor.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number, and all directional limitations, such as up and down and the like, can be switched, reversed, or changed as long as doing so is not prohibited by the language herein with regard to a particular version of the invention. Also, the various features of the versions herein can be combined in various ways to provide additional versions of the present invention. Furthermore, certain terminology has been used for the purposes of descriptive clarity, and not to limit the present invention. Throughout this specification and any claims appended hereto, unless the context makes it clear otherwise, the term "comprise" and its variations such as "comprises" and "comprising" should be understood to imply the inclusion of a stated element, limitation, or step but not the exclusion of any other elements, limitations, or steps. Throughout this specification and any claims appended hereto, unless the context makes it clear otherwise, the term "consisting of" and "consisting essentially of" and their variations such as "consists" should be understood to imply the inclusion of a stated element, limitation, or step and not the exclusion of any other elements, limitations, or steps or any other non-essential elements, limitations, or steps, respectively. Throughout the specification, any discussed on a combination of elements, limitations, or steps should be understood to include a disclosure of additional elements, limitations, or steps and the disclosure of the exclusion of additional elements, limitations, or steps. All numerical values, unless otherwise made clear in the disclosure or prosecution, include either the exact value or approximations in the vicinity of the stated numerical values, such as for example about +/−ten percent or as would be recognized by a person or ordinary skill in the art in the disclosed context. The same is true for the use of the terms such as about, substantially, and the like. Also, for any numerical ranges given, unless otherwise made clear in the disclosure, during prosecution, or by being explicitly set forth in a claim, the ranges include either the exact range or approximations in the vicinity of the values at one or both of the ends of the range. When multiple ranges are provided, the disclosed ranges are intended to include any combinations of ends of the ranges with one another and including zero and infinity as possible ends of the ranges. Therefore, any appended or later filed claims should not be limited to the description of the preferred versions contained herein and should include all such alterations, permutations, and equivalents as fall within the true spirit and scope of the present invention.

What is claimed is:

1. A method of creating an embedded concrete marking, the method comprising:

identifying a location on the surface of a concrete slab where an embedded concrete marking is to be created;

cutting a trench into the surface of the concrete slab at the identified location, the trench having a bottom surface and side walls, the bottom surface and side walls being a surface of the concrete slab;

applying a bonding agent to the bottom surface and side walls of the trench;

pouring a concrete mixture into the trench to a level where a float height of the concrete mixture is above the surface of the concrete, the concrete mixture being different when dry than the concrete into which the trench has been cut;

letting the concrete mixture at least partially harden; and removing a portion of the hardened concrete mixture to create a top surface of the concrete mixture that will form an embedded concrete marking, wherein the concrete mixture in the trench bonds with the concrete slab at the bottom surface and side walls of the trench.

2. The method according to claim 1 wherein the top surface is at least partially flush with the surface of the concrete.

3. The method according to claim 1 wherein the top surface is entirely flush with the surface of the concrete.

4. The method according to claim 1 wherein the bonding agent comprises one or more of an acrylic bonding agent, an epoxy, and a cement slurry coat.

5. The method according to claim 1 wherein the surface of the concrete is a surface of a concrete floor.

6. The method according to claim 1 wherein the trench is cut to a depth of at least about 0.25 inches below the surface of the concrete floor.

7. The method according to claim 1 wherein the trench is cut to a depth of from about 0.25 inches to about 0.75 inches below the surface of the concrete floor.

8. The method according to claim 1 wherein the trench is cut by one or more of shaving or planing using stacked diamond cutting saw blades, by using a concrete grinder, by scarifying, and by scoring and chipping.

9. The method according to claim 1 further comprising priming a surface of the trench with a priming agent before pouring the wet concrete mixture into the trench.

10. The method according to claim 1 wherein the step of letting the concrete mixture at least partially harden comprises letting the concrete mixture completely harden.

11. The method according to claim 1 wherein the step of letting the concrete mixture at least partially harden comprises letting the concrete mixture completely harden and cure.

12. The method according to claim 1 wherein the concrete mixture is poured to a float height of at least about one-sixteenth of an inch.

13. The method according to claim 1 wherein the concrete mixture is poured to a float height of from about one-sixteenth of an inch to about one-eighth of an inch.

14. The method according to claim 1 wherein the concrete mixture is different when dry than the concrete floor by being a different color.

15. The method according to claim 1 wherein the concrete mixture is different when dry than the concrete floor by being a different texture or different shine.

16. The method according to claim 1 wherein the concrete mixture comprises cement, aggregates, and a coloring agent.

17. The method according to claim 1 wherein the concrete mixture comprises one or more of iron oxide, metal oxide, and a synthetic pigment in a form or amount different than is present in the concrete floor.

18. The method according to claim 1 further comprising treating the top surface by honing, polishing, and/or sealing the surface.

19. A concrete surface with an embedded concrete marking made by the process comprising:

identifying a location on the surface of a concrete slab where an embedded concrete marking is to be created;

cutting a trench into the surface of the concrete slab at the identified location, the trench having a bottom surface and side walls, the bottom surface and side walls being a surface of the concrete slab;

applying a bonding agent to the bottom surface and side walls of the trench;

pouring a concrete mixture into the trench to a level where a float height of the concrete mixture is above the surface of the concrete, the concrete mixture being different when dry than the concrete into which the trench is cut;

letting the concrete mixture harden; and removing a portion of the hardened concrete mixture to create a top surface of the concrete mixture that will form an embedded concrete marking, wherein the concrete mixture in the trench bonds with the concrete slab at the bottom surface and side walls of the trench.

20. The concrete surface according to claim 19 wherein the bonding agent comprises one or more of an acrylic bonding agent, an epoxy, and a cement slurry coat.

* * * * *